US007992515B2

(12) United States Patent
von Keudell et al.

(10) Patent No.: US 7,992,515 B2
(45) Date of Patent: Aug. 9, 2011

(54) ELECTRODE HOLDER FOR A POWDER SPRAYING DEVICE

(75) Inventors: Leopold von Keudell, Salem (DE); Thomas Schwarz, St. Gallen (CH); Pierre Plascar, Rebstein (CH)

(73) Assignee: J. Wagner AG, Altstätten (CH)

( * ) Notice: Subject to any disclaimer, the term of this patent is extended or adjusted under 35 U.S.C. 154(b) by 1287 days.

(21) Appl. No.: 11/461,797

(22) Filed: Aug. 2, 2006

(65) Prior Publication Data

US 2007/0063077 A1 Mar. 22, 2007

(30) Foreign Application Priority Data

Aug. 12, 2005 (DE) ..... 20 2005 012 863 U

(51) Int. Cl.
*B05C 5/02* (2006.01)

(52) U.S. Cl. ..... 118/629; 118/308; 239/690; 239/708

(58) Field of Classification Search ..... 239/690, 239/704, 706, 707, 433; 361/226, 227, 230, 361/235; 118/629, 308; 427/475, 480
See application file for complete search history.

(56) References Cited

U.S. PATENT DOCUMENTS

| | | | | |
|---|---|---|---|---|
| 3,964,683 | A * | 6/1976 | Gimple | 239/691 |
| 4,020,393 | A * | 4/1977 | Porter | 361/227 |
| 4,802,625 | A * | 2/1989 | Buschor | 239/3 |
| 6,562,138 | B1 | 5/2003 | Haas | |

FOREIGN PATENT DOCUMENTS

| | | | |
|---|---|---|---|
| DE | 197 09 786 | | 2/1998 |
| DE | 198 38 278 | | 2/2000 |
| EP | 1 105 220 | B1 | 6/2001 |
| SU | 1558601 | * | 4/1990 |

OTHER PUBLICATIONS

European Search Report for corresponding Application No. 06405341.6 dated Apr. 24, 2007.

* cited by examiner

*Primary Examiner* — Laura Edwards
(74) *Attorney, Agent, or Firm* — Renner, Otto, Boisselle & Sklar, LLP

(57) ABSTRACT

An electrode holder for a powder spraying device includes a powder channel and a bridge arranged into the powder channel for holding an electrode. In addition a wedge is provided, which can be fixed on the bridge, on the upstream side of the bridge.

13 Claims, 5 Drawing Sheets

ELECTRODE HOLDER FOR A POWDER SPRAYING DEVICE

TECHNICAL FIELD

In the electrostatic powder coating, the work piece to be coated is coated with a layer of electrostatically loaded powder with a powder spray gun in a first working cycle. In a subsequent working cycle the work piece coated with the powder is warmed up until the powder on the surface of the work piece melts and forms a closed layer. After the cooling off of the work piece, this layer is a closed, firmly adherent protection layer. So that the powder can be loaded electrostatically, an electrode holder with an electrode being under high voltage is placed in the powder spray gun. The powder flows by the electrode and is thus electrostatically charged.

The invention relates to an electrode holder for the powder spraying device and to a powder spraying device for coating a work piece with coating powder.

BACKGROUND OF THE INVENTION

An electrode holder for a powder spray gun is known from the state of the art EP 1 105 220 B1. The electrode holder includes an outer tube piece, wherein a bridge and an inner tube piece are arranged. The inner tube piece is connected to the bridge and arranged downstream behind the bridge. The inner tube piece proceeds wedge-shaped at the upstream end, so that the powder flows laterally along the inner tube piece. The wedge-shaped end of the inner tube piece is however subject to wear, and especially then if abrasive or chafing powder is used. If the wedge-shaped end of the inner tube piece has become too distorted in the course of the time, the flowing of the powder changes, the powder adheres to the inner tube piece and the electrode holder can no longer be easily cleaned. In this case the entire electrode holder must be replaced.

SUMMARY OF THE INVENTION

An object of the invention is to provide an electrode holder for a powder spraying device and a powder spraying device, wherein flashovers from the high voltage on the powder are avoided.

Another object of the invention is to provide an electrode holder for a powder spraying device and a powder spraying device, wherein the possibility exists to replace only the components subject to the wear and tear.

Advantageously, in the case of the invention, the area, which is especially strongly exposed to the powder, can be executed more wear resisting than the remaining areas, without the electrode holder and the powder spraying device becoming more complex due to it or becoming more time and cost consuming to manufacture.

Another object of the invention is to provide a powder spraying device, wherein the powder is evenly swirled and homogeneously distributed at the upstream end of the powder channel.

According to one aspect of the invention, an electrode holder for a powder spraying device is provided. The electrode holder includes a powder channel and a bridge arranged into the powder channel for holding an electrode. The upstream section of the powder channel is developed as sleeve, in which a powder tube can be pushed into. Furthermore an electric contact, which is arranged on the upstream fore-part of the sleeve, is provided.

According to another aspect of the invention, an electrode holder for a powder spraying device includes a powder channel and a bridge arranged into the powder channel for holding an electrode. In addition a wedge is also provided, which can be fixed on the bridge, on the upstream side of it.

In accordance with still another aspect of the invention, a powder spraying device has a powder channel and a bridge arranged into the powder channel for holding an electrode. In addition a powder spraying nozzle having a nozzle slot is also provided, whereby the axial distance between the downstream end of the bridge and the internal edge of the nozzle slot parallel to it is of 6 to 15 mm.

Advantageously the electric contact is developed as contact ring in the case of the electrode holder according to the invention. In that way, the electrode holder can be installed into the powder spraying device in each position, whereby a safe electric contacting is nevertheless guaranteed.

In an embodiment of the electrode holder according to the invention, the connection, through which the wedge can be fixed on the bridge, is developed as plug connection. This is a simple and economic connection, which allows at the same time the possibility to quickly exchange the wedge if required.

In another embodiment of the electrode holder according to the invention, the bridge has a taper on its upstream side and the wedge has two brackets, which can be plugged-in on the taper.

In an additional embodiment of the electrode holder according to the invention the plug connection is developed as self-centering plug connection. This simplifies the mounting of the wedge and ensures that the wedge always has the right position.

Advantageously, in the case of the electrode holder according to the invention, the wedge has polypropylene, polyoxymethylene, glass or ceramic. As a result the wedge becomes abrasion resistant.

In addition, in the case of the electrode holder according to the invention, the wedge can be positioned in such a way that its pointed end ends where the powder tube begins.

The electrode holder can also be equipped with an air duct, through which the electrode can be supplied with air. Moreover, an annular seal arranged downstream behind the air duct can also be provided. The seal can be part of the electrode holder or the mounting sleeve. Preferably, it is however part of the electrode holder.

In the case of the electrode holder according to the invention a sleeve can be provided, which is located on the upstream side of the powder channel and which is suitable to accommodate a powder tube. This has the advantage that in that way an insulating section is formed between the sleeve and the powder tube, such insulating section preventing a skipping of the high voltage on the powder.

For solving the object it is also recommended to equip the electrode holder with an electric contact ring. As a result the electrode holder can be rotated around the longitudinal axis and the electrode can be supplied with current independently from the orientation of the electrode holder.

In a further development of the electrode holder according to the invention, the contact ring is arranged on the upstream fore-part of the sleeve.

The powder spraying device according to the invention includes a mounting sleeve, which holds the electrode holder. The mounting sleeve shows a stopper, whereby the powder tube is clamped between the stopper and the electrode holder. This way, the transition from the powder tube to the electrode holder can be simply sealed.

In the case of a further development of the powder spraying device a nozzle is provided, which has a nozzle slot, whereby the nozzle and the electrode holder are developed in such a way that, in the joined state, the nozzle slot runs parallel to the edge of the wedge. As a result the powder is distributed homogenously.

Finally, in the case of the powder spraying device, the axial distance between the downstream end of the bridge and the internal edge of the nozzle slot parallel to it is of 6 to 15 mm.

BRIEF DESCRIPTION OF THE DRAWINGS

These and other aspects of the invention are apparent from and will be elucidated in details with reference to the seven figures described hereinafter.

DETAILED DESCRIPTION OF THE INVENTION

Figure 1:
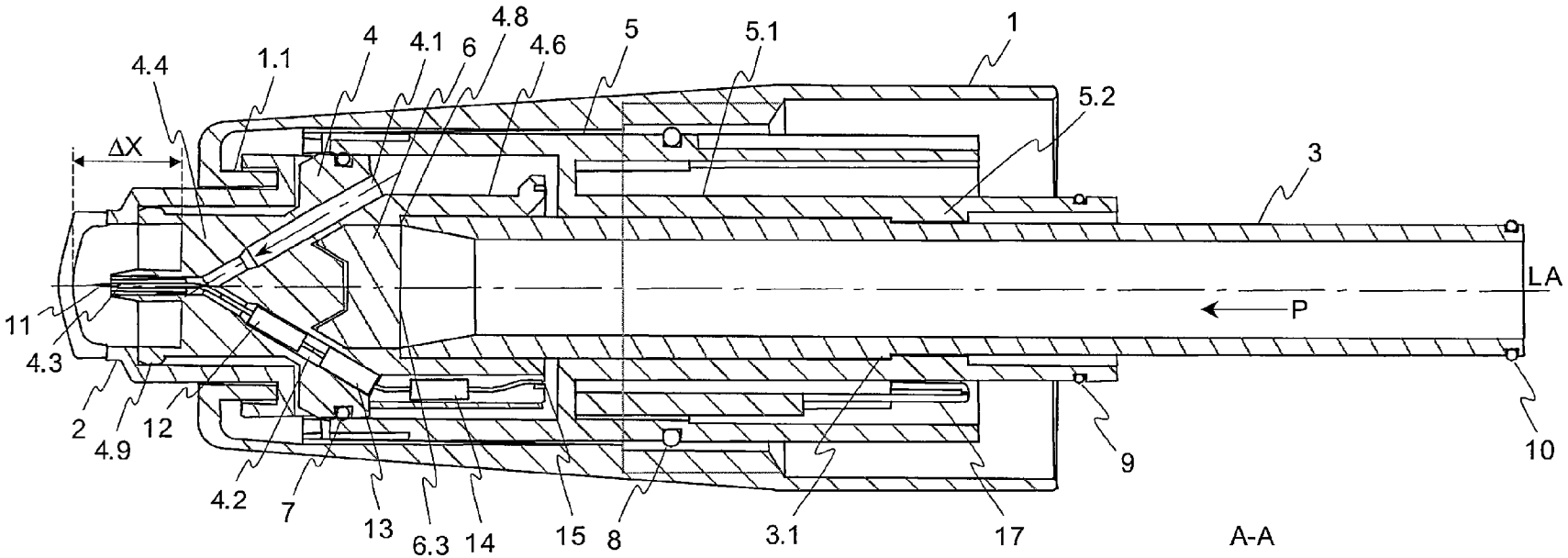
FIG. 1 shows the front part of the powder spraying device with a possible embodiment of the electrode holder according to the invention in a cross-section.

In FIG. 1 the front part of a powder spraying device is represented in a cross-section along the intersection line A-A. The course of the intersection line A-A is to infer from the three-dimensional view shown in FIG. 3. The front part of the powder spraying device 20 is accommodated in a housing 1, whereby the housing 1 can be screwed-on on a pistol shaft 21 forming a rear part of the powder spraying device 20 shown in FIG. 7.

In order to screw the housing 1 with the shaft 21, the housing 1 is provided with an internal screw thread and the shaft 21 with an external screw thread. A nozzle 2 sticks out from the downstream end of the housing 1. At the upstream end of the nozzle 2, the nozzle 2 has an annular groove for the fastening, into which an annular bracket of the housing 1 reaches. If the housing 1 is loosely screwed-on on the pistol shaft 21 of the powder spraying device 20, the nozzle 2 can be rotated around the longitudinal axis LA. In this way the nozzle slot 2.1, see FIG. 2, can be brought into the desired position.

A mounting sleeve 5 is arranged between the housing 1 and the powder tube 3, through which the nozzle 2 is supplied with powder P. The mounting sleeve 5 is led through the inside wall of the housing 1 and airtight sealed with an O-ring 8 opposite the downstream area of the housing 1. A tubular guide 5.1, which is used for guiding the powder tube 3, is located inside the mounting sleeve 5. A shoulder 5.2, which is used as stopper, is embedded in the tubular guide 5.1. The powder tube 3 also has a corresponding stopper 3.1. With its help the powder tube 3 can be clamped between an electrode holder 4 and the shoulder 5.2 of the mounting sleeve 5. The electrode holder 4 shows, on its upstream side, a sleeve 4.6, in which the powder tube 3 can be pushed into up to the stopper 4.8. Opposite the mounting sleeve 5, the electrode holder 4 is airtight sealed using an O-ring 7, so that the electrode air L cannot escape from between the electrode holder 4 and the mounting sleeve 5.

A flat bridge 4.4 is located inside the electrode holder 4. The bridge 4.4 shows an air duct 4.1 and another duct 4.2. Both ducts 4.1 and 4.2 are connected together downstream and form a common duct. Two resistances 12 and 13 are arranged inside the duct 4.2 and using the two resistances 12 and 13 a high voltage electrode 11 can be supplied with current. The electrode 11 protrudes from the bridge 4.4 at the opening 4.3 of the common duct. With help of the electrode being under high voltage 11, the powders P directed past electrode 11 is charged electrostatically.

On the upstream side of the bridge 4.4, a wedge 6 is placed on the bridge 4.4 to lead the powder P as unhindered as possible past both sides of the bridge 4.4. The form of the plug connection between the wedge 6 and the bridge 4.4 is selected in such a way that the wedge 6 centers itself opposite the bridge 4.4. As it can be perceived in FIG. 1, the bridge 4.4 and the wedge 6 show for this purpose trapezoidal running guide edges suitable to each other. The upstream edge 6.3 of the wedge 6 divides the powder flow and ends evenly with the step 4.8 of the electrode holder 4. Consequently the wedge 6 does not extend into the powder tube 3.

At the upstream end of the sleeve 4.6, an electric contact ring 15 is located at the front of the sleeve 4.6. A guide ring 4.9, though which the electrode 11 is centered compared with the nozzle 2, is located at the downstream end 4.10 of the electrode holder 4.

The axial distance ΔX between the downstream end of the bridge of 4.4 and the point, at which the inside edge of the nozzle slot 2.1 runs parallel to the downstream end of the bridge 4.4, is of 6 to 15 mm. If the inside edge of the nozzle slot 2.1, as shown in FIG. 1, is bent, the point is located there where the inside edge of the nozzle slot 2.1 cuts the longitudinal axis LA. In the following this position is denominated in short as parallel inside edge of the nozzle slot and is marked in FIG. 1 using the left dotted subsidiary line. Preferably the distance ΔX is of 12 mm. A homogeneous distribution of the powder is favored in the case of this distance. Among other things, the electrostatic charging of the powder is also improved by it.

Moreover, it is advantageous to shorten the distance between the upstream edge 6.3 of the wedge 6 and the nozzle slot 2.1. Consequently the swirling and with it also the homogeneity of the powder in the powder channel 4.5 is maintained up to the nozzle slot 2.1.

Figure 2:
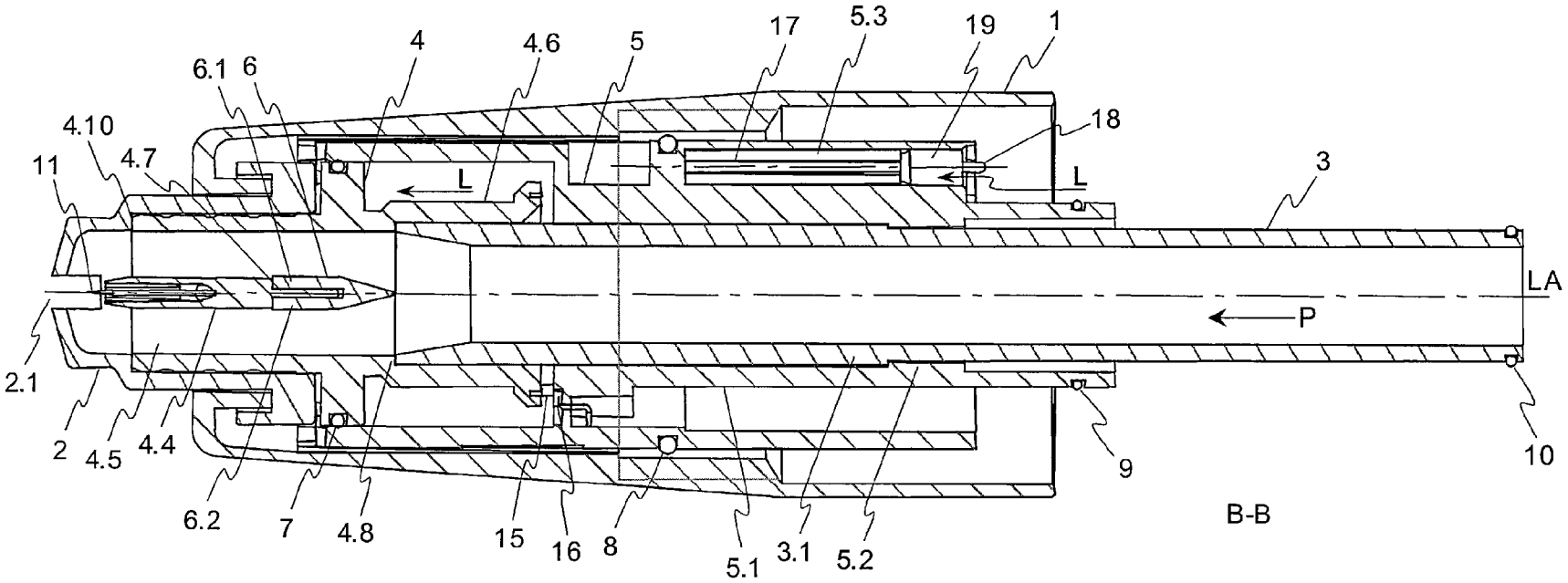
FIG. 2 shows the front part of the powder spraying device with the electrode holder in a second cross-section.

The front part of the powder spraying device 20 along the cut B-B is represented in FIG. 2. The course of the intersection line B-B is to infer from FIG. 3. The bridge 4.4 shows at the upstream end a taper 4.7 and the wedge 6 shows two brackets 6.1 and 6.2, which are pushed across the taper 4.7. As a result the wedge 6 can be removed from the bridge 4.4. On one side this plug connection has the advantage that as soon as the wedge 6 is worn-out, this one can be replaced by a new wedge without the entire electrode holder 4 having to be replaced for this purpose. On the other side the wedge 6 can be made from a material, which is especially friction resistant and abrasion resistant. The wedge 6 can also be designed for special powder types. Different wedges adapted to the respective powder type can be used for different powder types. Polypropylene, polyoxymethylene, glass and ceramics are examples for materials, which are suitable for the wedge 6. Polypropylene, short form PP, is also occasionally called polypropene and is a semi-crystalline thermoplastic synthetic material. Polypropylene has a higher stiffness, hardness and solidity than polyethylene. Polyoxymethylene, short form POM, is also called polyacetal and is also a semi-crystalline thermoplastic synthetic material. Polyoxymethylene has a high stiffness and solidity, a low coefficient of friction, a high abrasion resistance and an excellent dimensional stability. Moreover POM remains hard in a wide temperature range and has good electric and dielectric properties.

The electrode holder 4 however can be manufactured from other material than the wedge 6. The electrode holder 4 is produced advantageously as injection molded part, because this is cost-effective and for this reason a consistently high accuracy is guaranteed in the serial production.

A channel 5.3 is available in the mounting sleeve 5, such channel 5.3 conducts an electric line 17 and an air filter 19 is mounted in its upstream opening. In addition there a contact point 18 is located, through which the conductor 17 can be connected to a power supply not shown here. In operation, the electrode air L flows through the air filter 19 into the channel 5.3, from there into the space between electrode holder 4 and guide sleeve 5 and from there across the channel 4.1 from the opening 4.3 of the bridge 4.4.

Due to the shaping of the connection shown in the FIGS. 1 and 2 the contact surfaces between the wedge 6 and the bridge 4.4 are not exposed to the wear. Therefore the connection remains fully functional even over a longer period. Sediment of powder is also avoided thanks to the shaping of the connection. The two brackets 6.1 and 6.2 of the wedge 6 can be clamping executed. As a result of the dynamic pressure in the powder channel, which occurs due to the powder flowing in together with the conveying air, the wedge 6 is pressed in axial direction on the bridge 4.4. The shaping of the brackets 6.1 and 6.2 and of the taper 4.7 ensures that forces directed cross-wise to the longitudinal axis LA, which can occur due to turbulences in the powder-air flow, are received safely during the operation.

The inside of the sleeve 4.6 forms, together with the outside of the powder tube 3, a sufficiently long insulating section. This can prevent the high voltage from the contact ring 15 and respectively the contact point 16 from coming prematurely in contact with the powder in the upstream section of the electrode holder 4. The embodiment shown in the figures has the further advantage that the electric contact points 15 and 16 are far away from the nozzle slot 2.1 and from air gaps so that the danger of voltage flashovers is minimized even further.

In the assembled state, the annular bracket 1.1 of the housing 1 presses on the annular groove of the nozzle 2, which in turn presses on the downstream end 4.10 of the electrode holder 4. The electrode holder 4 in turn presses over the step 4.8 on the fore-part of the powder tube 3. Finally the powder tube 3 presses on the shoulder 5.2 of the mounting sleeve 5 through the step 3.1. This creates a sufficient seal between all components in a simple manner.

A springy electric contact point 16 is located on the downstream side of a step in the mounting sleeve 5, such springy electric contact point 16 is connected on the one hand to the contact ring 15 and on the other hand to an electric contact point 18, which is on the upstream side of the mounting sleeve 5.

Figure 7:
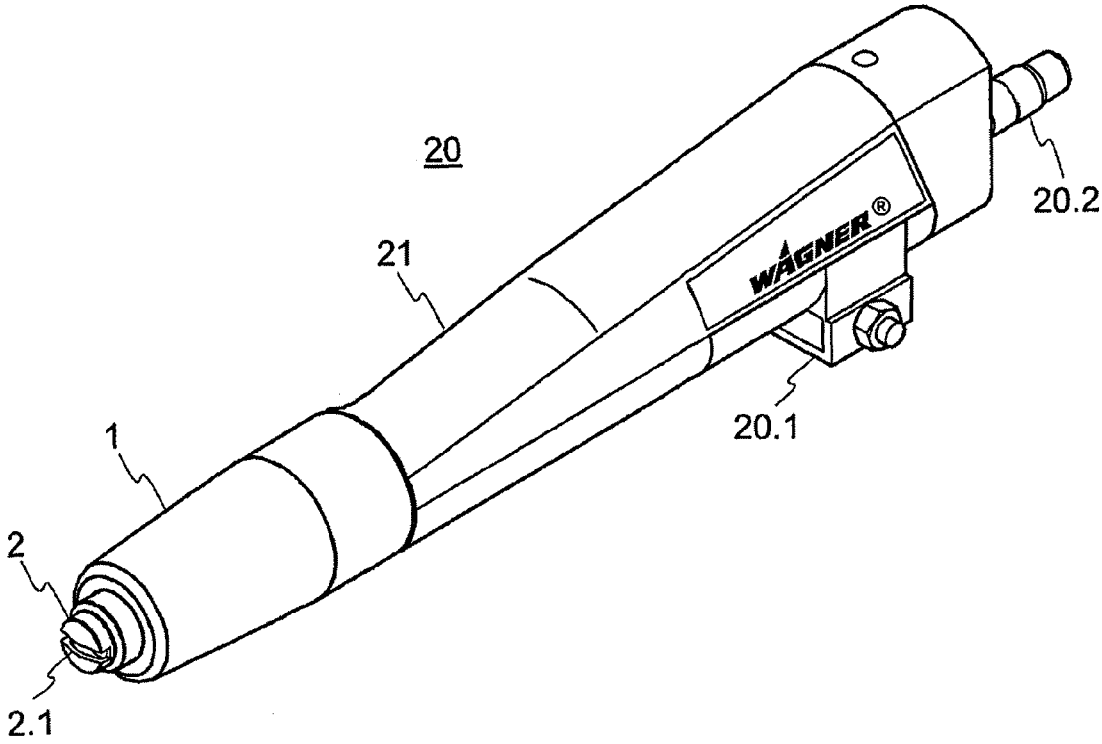
FIG. 7 shows a possible embodiment of the powder spraying device.

Two seals 9 and 10 are provided for sealing the mounting sleeve 5 and the powder tube 3 opposite shaft 21 of the powder spraying device 20 shown in FIG. 7. These can be developed as O-rings.

Figure 3:
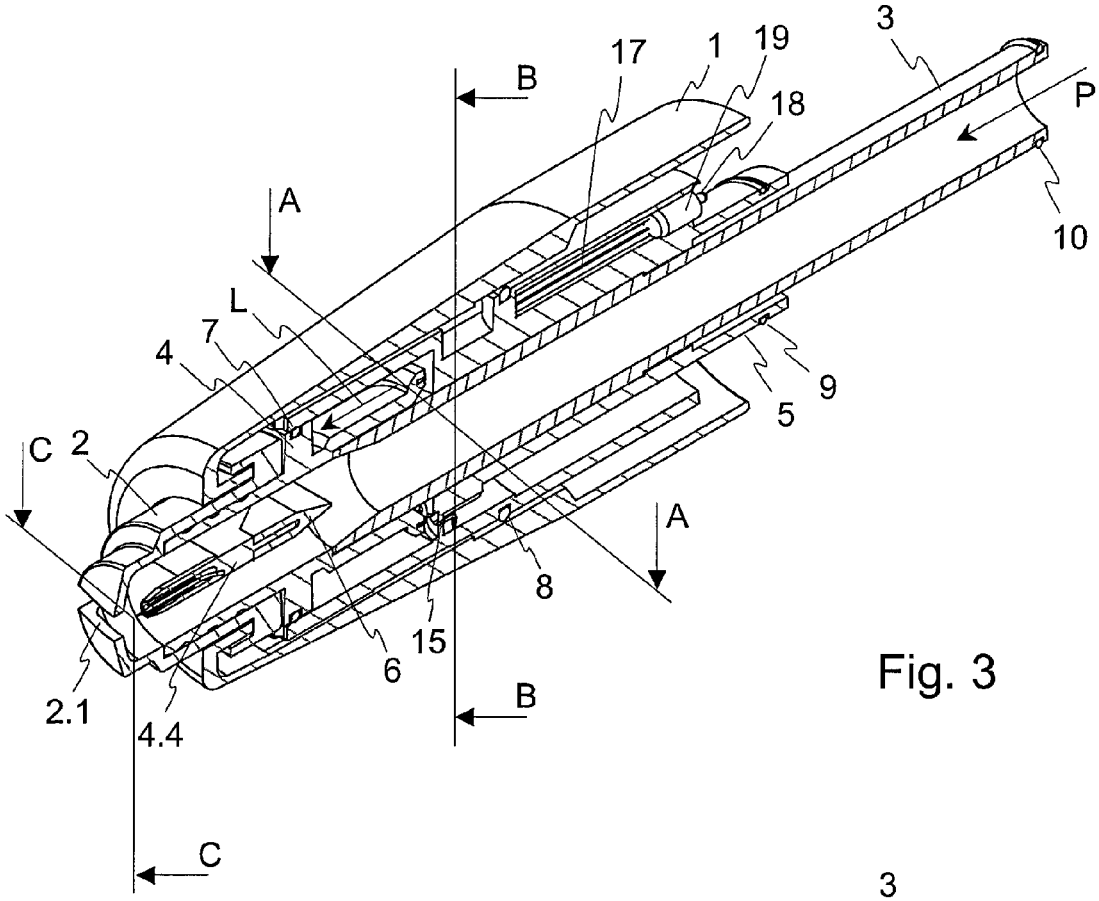
FIG. 3 shows the front part of the powder spraying device in a three-dimensional view in a cross-section.

The downstream part of the powder spraying device 20 is shown in a cross-section and in a three dimensional view in FIG. 3.

Figure 4:
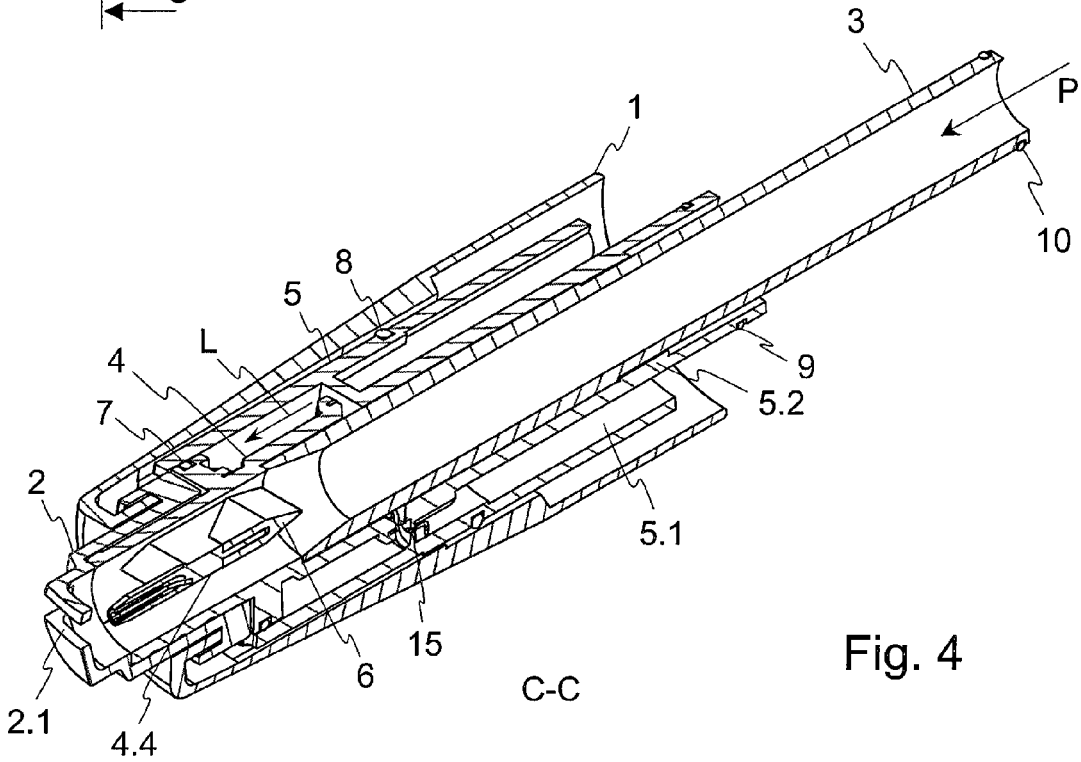
FIG. 4 shows another cross-section of the front part of the powder spraying device in a three-dimensional view.

The downstream part of the powder spraying device 20 along the intersection line C-C is also shown in a three dimensional view in FIG. 4.

Figure 5:
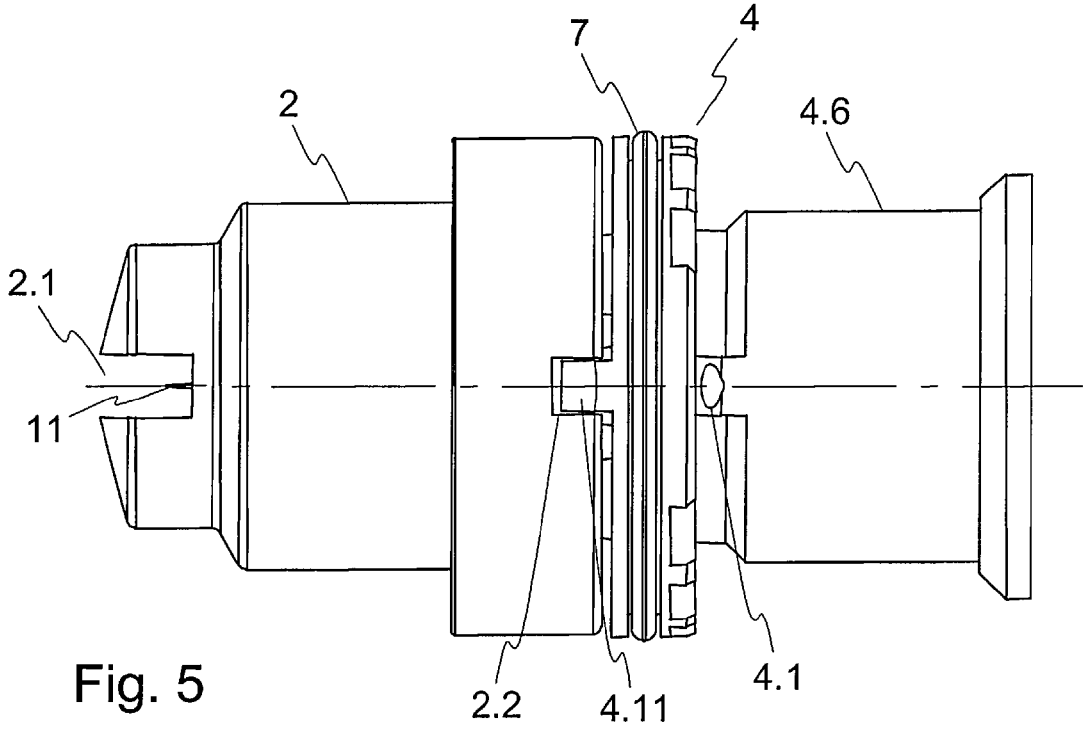
FIG. 5 shows the nozzle 2 and the electrode holder 4 in the side view.
Figure 6:
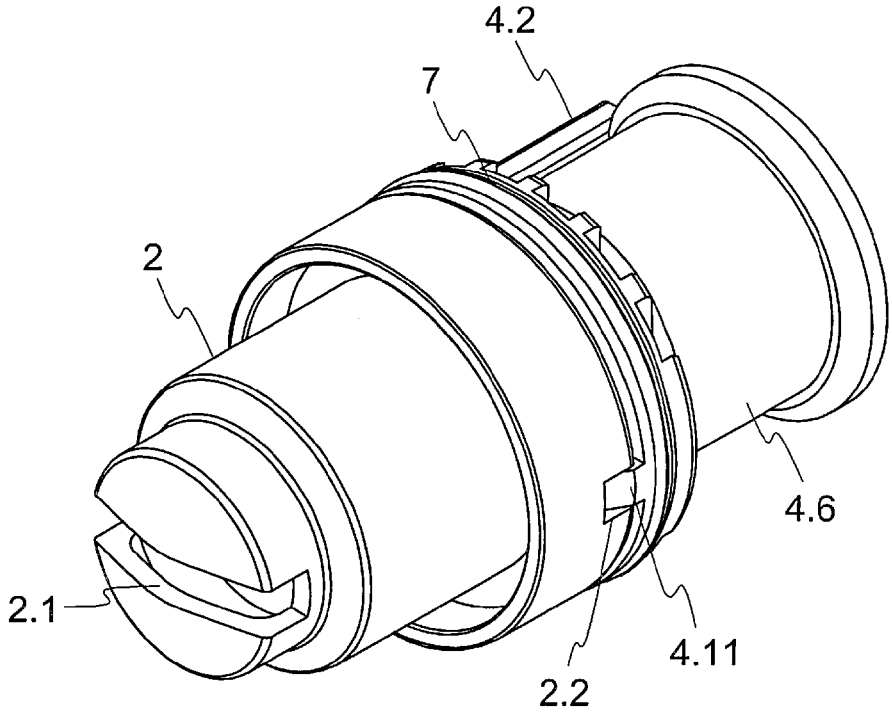
FIG. 6 shows the nozzle 2 and the electrode holder 4 in a three-dimensional view.

The nozzle 2 and the electrode holder 4 are shown in FIG. 5 in a lateral view and in FIG. 6 in a three-dimensional view. The electrode holder 4 and the nozzle 2 have a nose 4.11 and respectively a groove 2.2, which together form a form-fitting connection. By this coupling of the electrode holder 4 with the nozzle 2 it is achieved that the position of the nozzle slot 2.1 compared to the wedge edge 6.3 is permanently predetermined. If the housing 1 compared to the rear, upstream part of the powder spraying device is loosened, the nozzle 2 can be rotated together with the electrode holder 4 without that in that way the rotating position of the nozzle slot 2.1 changes compared to the wedge edge 6.3.

A possible embodiment of the powder spraying device, which is also called powder spray gun, is shown in FIG. 7. The electrode holder according to the invention can be used in such a type of powder spray gun. A pistol holder 20.1 is located on the underside of the shaft 21 of the powder spraying device 20 and by means of this pistol holder 20.1 the powder spraying device 20 can be fixed on an arm of a linear guide. The powder spraying device 20 is supplied with powder and air using the supply connection 20.2.

The preceding description of the embodiments according to the present invention is used only for illustrative purposes and not for the purpose of restricting the invention. Different alterations and modifications are possible within the framework of the invention without leaving the scope of the invention and its equivalents.

LIST OF REFERENCE SYMBOLS

1 Pistol housing
1.1 Annular bracket
2 Nozzle
2.1 Nozzle opening
2.2 Groove
3 Powder tube
3.1 Step in the powder tube
4 Electrode holder
4.1 First duct
4.2 First duct
4.3 Opening
4.4 Bridge
4.5 Powder channel
4.6 Sleeve
4.7 Taper
4.8 Stopper
4.9 Guide ring
4.10 downstream end of the electrode holder
4.11 Nose
5 Mounting sleeve
5.1 Tubular guide
5.2 Shoulder
5.3 Air duct
6 Wedge
6.1 First bracket
6.2 Second bracket
6.3 Edge
7 Sealing ring
8 Sealing ring
9 Sealing ring
10 Sealing ring
11 Electrode
12 Resistance
13 Resistance
14 Resistance
15 Contact ring
16 Electrical contact

17 Electric line
18 Electrical contact
19 Air filter
20 Powder spray gun
20.1 Pistol holder
20.2 Supply connection
21 Pistol shaft
LA Longitudinal axis
L Direction of flow of the air
P Direction of flow of the powder

The invention claimed is:

1. An electrode holder for a powder spraying device, wherein powder is conveyed in the powder spraying device through a powder tube to the electrode holder, the electrode holder comprising:

a powder channel that forms a sleeve for receiving the powder tube pushed into the sleeve, a bridge arranged in the powder channel for holding an electrode configured to electrostatically charge powder directed past the electrode from the powder tube, and an electric contact, which is arranged on the upstream fore-part of the sleeve and configured to supply a voltage to the electrode.

2. The electrode holder according to claim 1, wherein the electric contact is developed as contact ring.

3. The electrode holder according to claim 1, further comprising a wedge, fixed on an upstream side of the bridge, wherein the wedge directs powder from the powder channel past the bridge.

4. The electrode holder according to claim 3, wherein a connection, through which the wedge is fixed on the bridge, is developed as plug connection.

5. The electrode holder according to claim 3, wherein the bridge has a taper on its upstream side, and the wedge has two brackets, which are plugged-in on the taper.

6. The electrode holder according to claim 3, wherein the wedge comprises a plug connection that centers the wedge opposite the bridge.

7. The electrode holder according to claim 3, wherein the wedge has polypropylene, polyoxymethylene, glass or ceramic.

8. The electrode holder according to claim 3, wherein the wedge has a pointed end and is positioned in such a way that its pointed end ends there where the powder tube begins.

9. The electrode holder according to claim 1, further comprising:

an air duct, through which the electrode is supplied with air (L), and an annular seal arranged downstream behind the air duct.

10. A powder spraying device comprising:

the electrode holder according to claim 1, the powder tube for conveying powder to the electrode holder, and a mounting sleeve, which holds the electrode holder and which has a stopper, whereby the powder tube is clamped between the stopper and the electrode holder.

11. A powder spraying device comprising:

the electrode holder according to claim 1, the powder tube for conveying powder to the electrode holder, a wedge that directs powder from the powder tube past the bridge, and a nozzle at a downstream end of the powder conveying device for receiving the powder from the powder tube, which has a nozzle slot, wherein the nozzle slot runs parallel to the edge of the wedge in the joined state.

12. The powder spraying device according to claim 11, wherein an axial distance ($\Delta X$) between a downstream end of the bridge and an internal edge of the nozzle slot parallel to an internal edge is of 6 to 15 mm.

13. A powder spraying device comprising:

a powder channel for conveying powder, a bridge arranged in the powder channel for holding an electrode that electrostatically charges powder directed past the electrode from the powder channel, and a powder spraying nozzle at a downstream end of the powder conveying device for receiving the powder from the powder channel and having a nozzle slot, wherein an axial distance ($\Delta X$) between a downstream end of the bridge and an internal edge of the nozzle slot parallel to an internal edge is of 6 to 15 mm.

* * * * *